US009767647B2

(12) United States Patent
En

(10) Patent No.: US 9,767,647 B2
(45) Date of Patent: Sep. 19, 2017

(54) GAME RESULT INDEX TRANSACTION SYSTEM

(71) Applicant: Gan Kok En, Seremban (MY)

(72) Inventor: Gan Kok En, Seremban (MY)

( * ) Notice: Subject to any disclaimer, the term of this patent is extended or adjusted under 35 U.S.C. 154(b) by 193 days.

(21) Appl. No.: 14/587,681

(22) Filed: Dec. 31, 2014

(65) Prior Publication Data

US 2016/0189475 A1 Jun. 30, 2016

(51) Int. Cl.
*G07F 17/32* (2006.01)

(52) U.S. Cl.
CPC ..... *G07F 17/3244* (2013.01); *G07F 17/323* (2013.01)

(58) Field of Classification Search
CPC ..... G07F 17/32
See application file for complete search history.

(56) References Cited

U.S. PATENT DOCUMENTS

2002/0073021 A1* 6/2002 Ginsberg ..... A63F 3/081 705/38
2008/0085769 A1* 4/2008 Lutnick ..... G07F 17/32 463/41

* cited by examiner

*Primary Examiner* — Omkar Deodhar
(74) *Attorney, Agent, or Firm* — Muncy, Geissler, Olds & Lowe, P.C.

(57) ABSTRACT

A game result index transaction system is connected to at least one game end to allow at least one player to do transaction. An index is generated through an index conversion element based on game results of the game end. The index rises or falls with the game results generated continuously from the game end. Through an index transaction interface of an index transaction system the player can execute transaction of futures against the rise or fall of the index. Thus the invention allows the player to predict the game results of the game end to choose buying or selling of the futures, and get unrealized gain or loss with the rise or fall of the index, and close position to settle the actual gain or loss, therefore forms a novel play to satisfy player's fickle desire for change and excitement.

8 Claims, 10 Drawing Sheets

GAME RESULT INDEX TRANSACTION SYSTEM

FIELD OF THE INVENTION

The present invention relates to a game machine and particularly to a system for a novel play implemented on a game machine.

BACKGROUND OF THE INVENTION

Please referring to FIG. 1, a conventional game system includes a plurality of human machine operation interfaces 1 linked to a plurality of game machines 2 to allow players to operate the human machine operation interfaces 1 to select the intended game machines 2 to place bets. Such a practice can overcome space and environmental limitation to increase the number of the players that can be accommodated by each game machine 2. The players also can play different kinds of the game machines 2 to satisfy their fickle desire and preferences.

On the other hand, game providers, in order to meet players' requirements for novel games, have to constantly develop new game machines 2 and provide novel games and new play schemes to entice the players to increase usage of the game machines 2. The game machines 2 of a lower usage reflect their lack of appeal to the players, and have to be gradually retired and removed.

However, for the game machines 2 for gambling purpose, in order to ensure that their game return rate can comply with the rules and public trustworthiness of regulations, not only the game machines 2 that provide the new play schemes have to go through a prolonged period of test, they also are required to be authenticated by an impartial third party before shipping. Hence developing and providing new games is a tedious and time consuming process, and costly in implementation.

SUMMARY OF THE INVENTION

Therefore the primary object of the present invention is to provide a game result index transaction system that uses game results existed on present game ends as data source to provide a new play scheme to satisfy player's desire for novel play and also reduce the development time and cost of the game providers.

To achieve the foregoing object the game result index transaction system of the invention is connected to at least one game machine to allow at least one player to make transaction. The game result index transaction system includes a database, an index conversion element and an index transaction unit. The database is connected to the game machine and registers game results of each game machine. The index conversion element is connected to the database and generates an index based on the game results of the game machine, and the index rises and falls according to the continuously generated game results at the game machine. The index transaction system is connected to the index conversion element to get the rise and fall of the index. The index transaction system also has a transaction interface to allow the player to make transactions of futures against the rise and fall of the index.

Thus, through the invention the player can predict the game results of each game machine and choose to buy or sell the futures. When the index rises or falls the player can get unrealized gains or losses. When the player close a position, the actual gains and losses can be settled. Therefore it is a new play scheme that can satisfy player's fickle desire for novel games and change. For the game providers, the game results of the existing game machines become data source, hence generation of the game results has public credibility without the need of test for a prolonged period, and also does not require authentication through an impartial third party. As a result, development time and implementation cost also can be reduced.

The foregoing, as well as additional objects, features and advantages of the invention will be more readily apparent from the following detailed embodiments and description, which proceed with reference to the accompanying drawings. The embodiments serve merely for illustrative purpose and are not the limitation of the invention.

DETAILED DESCRIPTION OF THE PREFERRED EMBODIMENTS

Figure 1:
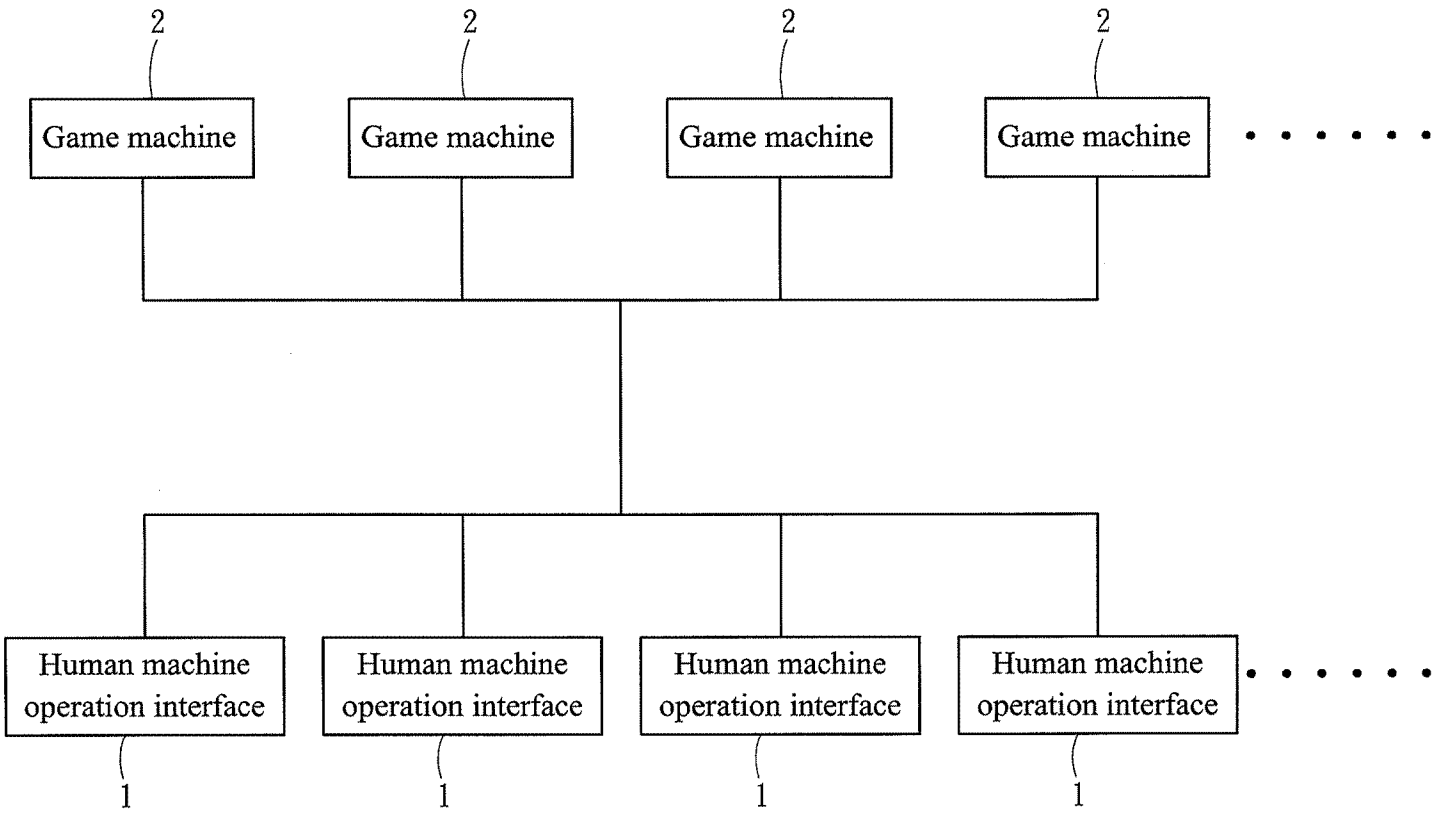
Fig. 1 PRIOR ART
FIG. 1 is a schematic view of a conventional system architecture.
Figure 2:
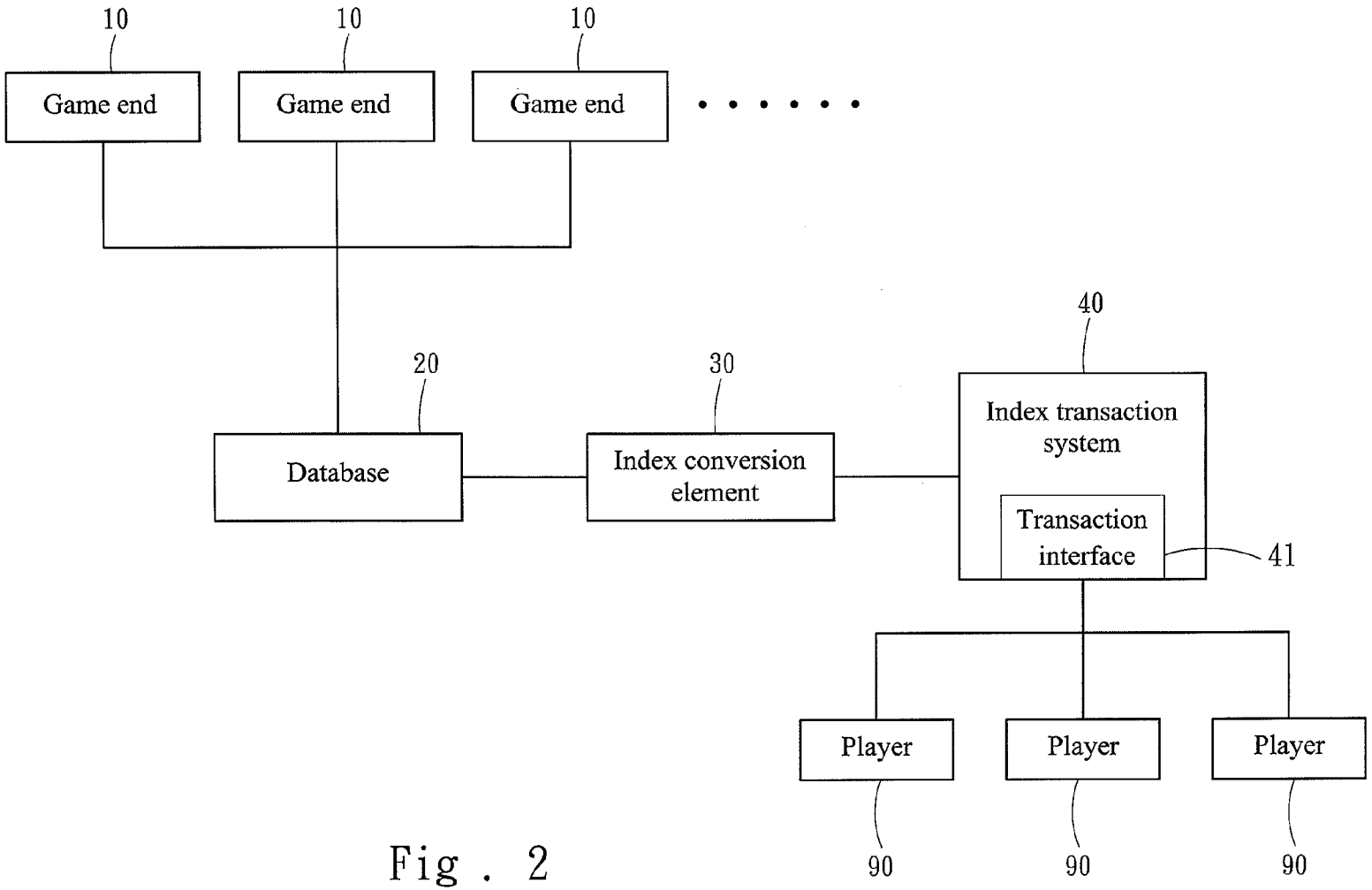
FIG. 2 is a schematic view of system architecture of the invention.
Figure 3A:
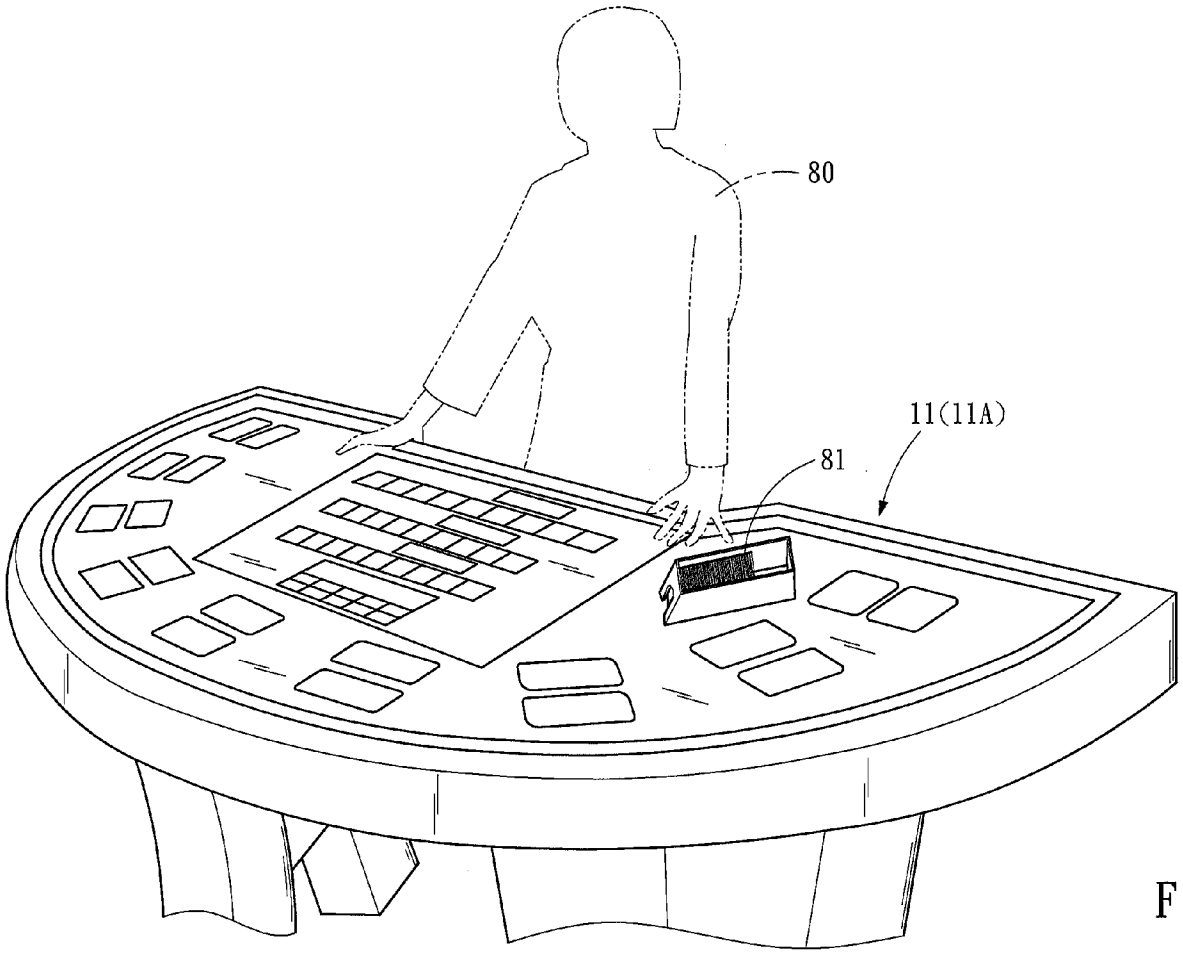
FIGS. 3A through 3C are schematic views of the structures of physical tabletop games according to the invention.
Figure 3B:
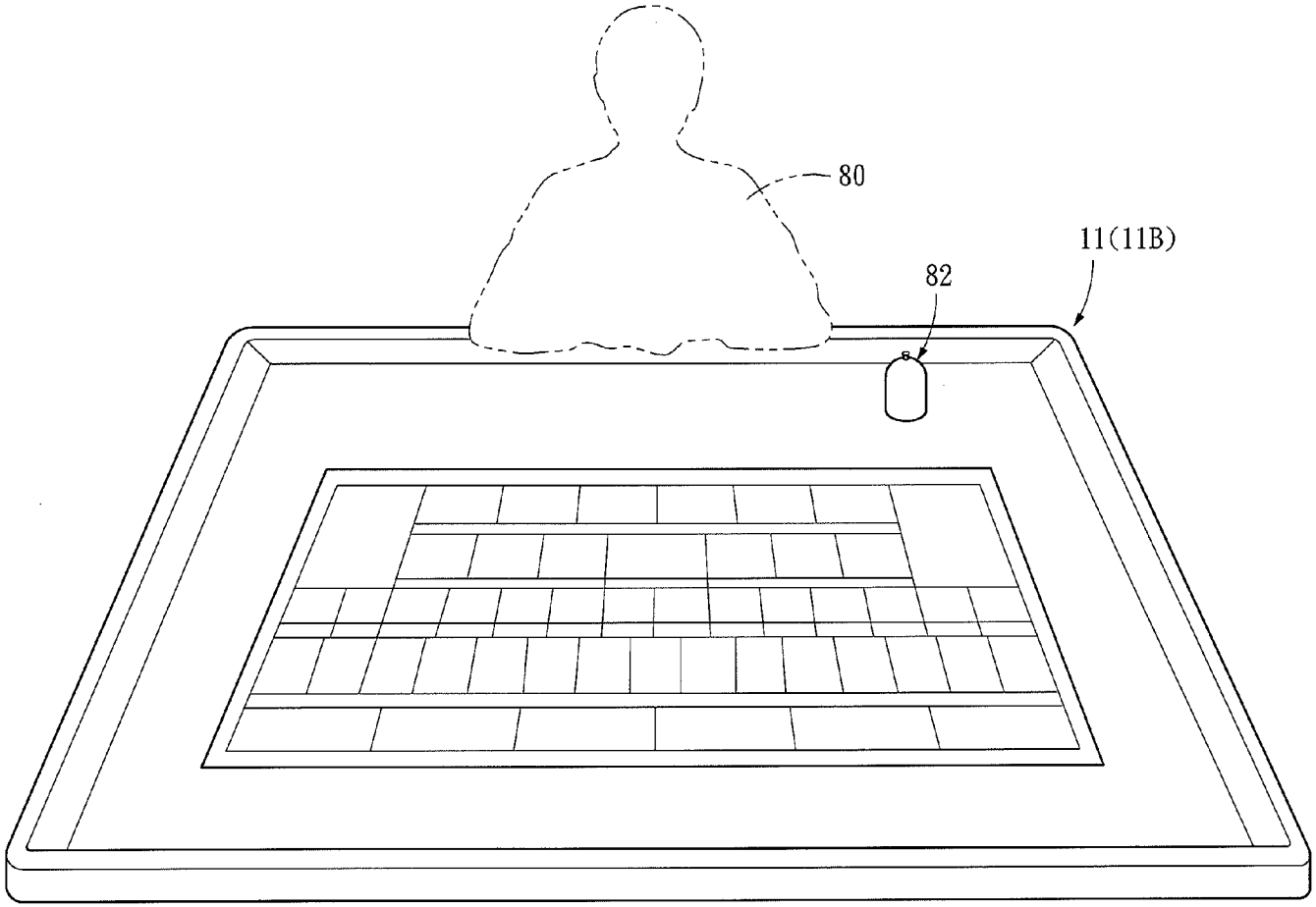
Figure 3C:
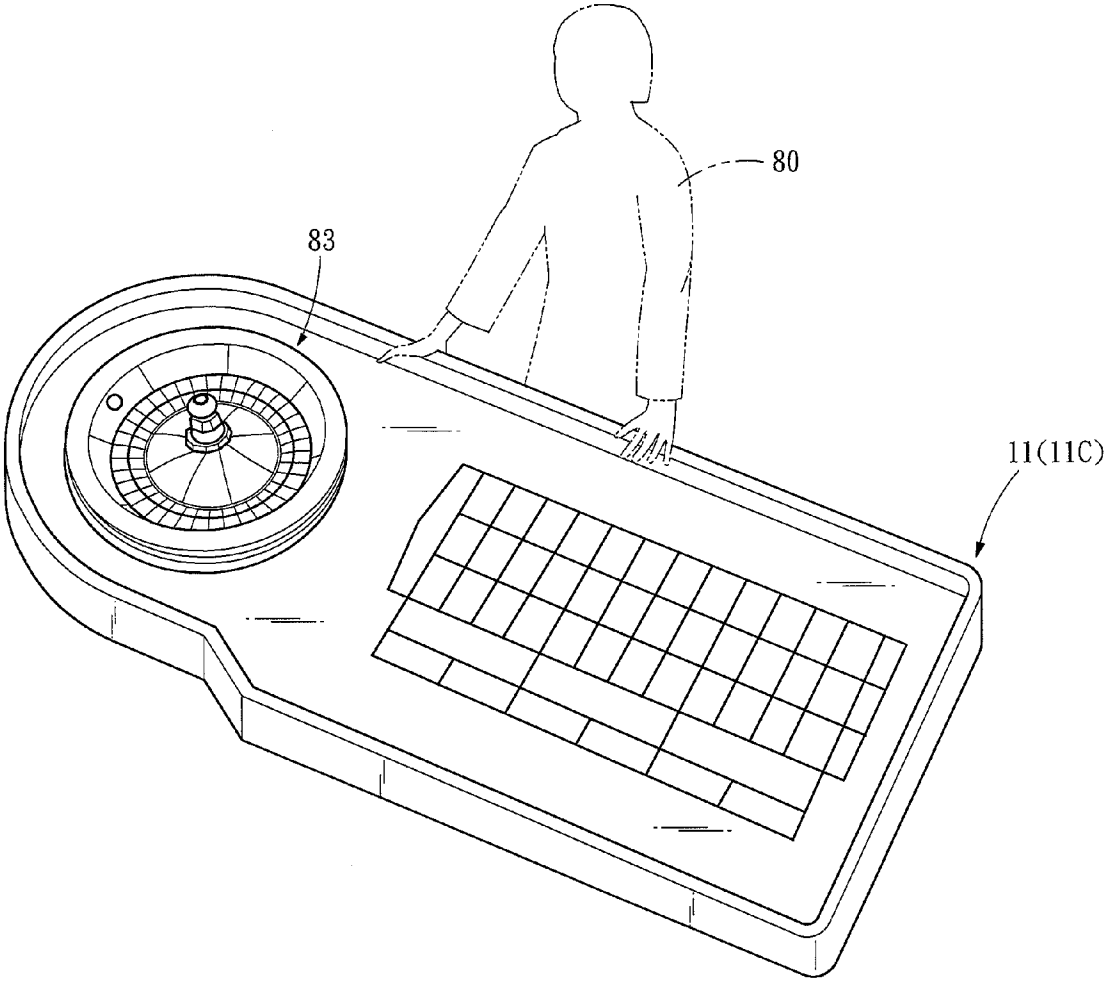
Figure 4:
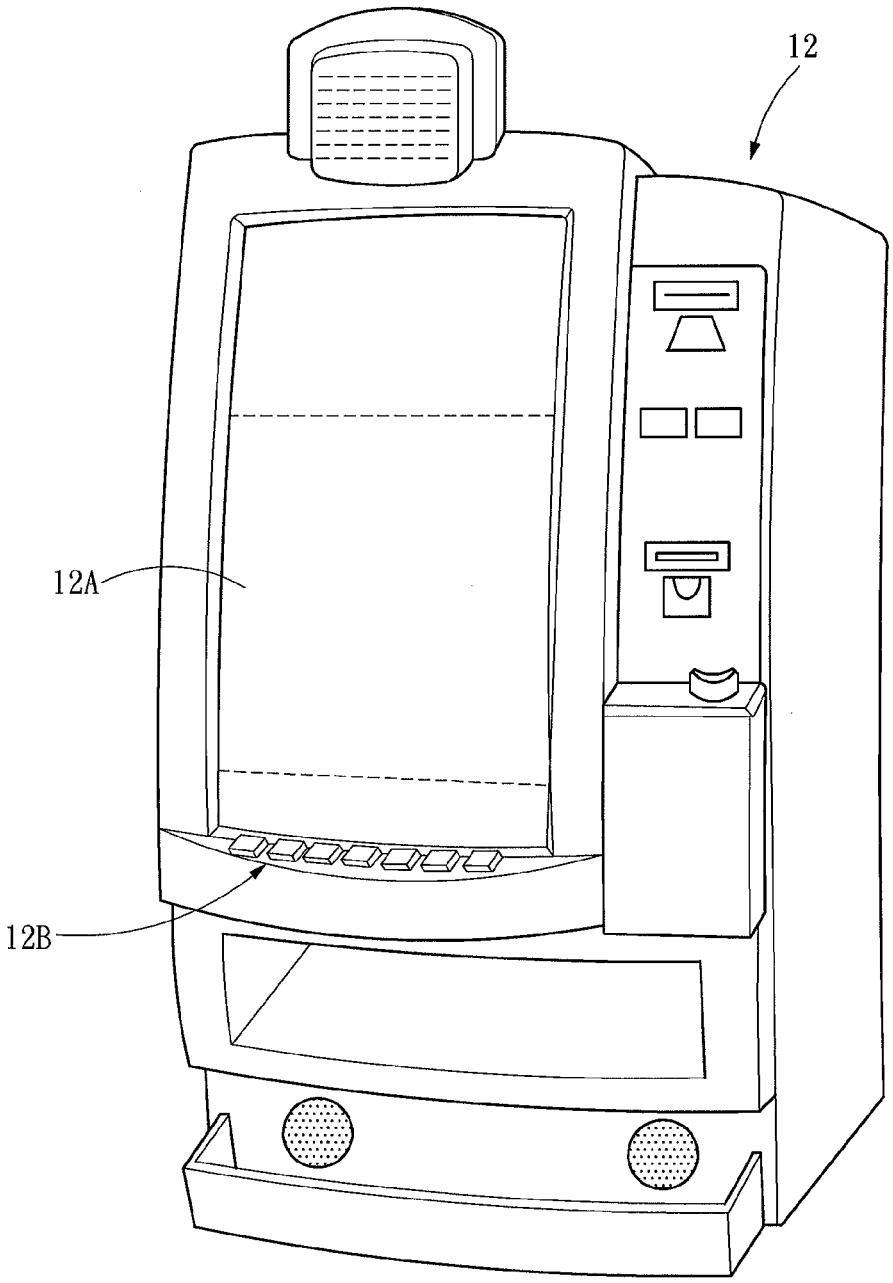
FIG. 4 is a schematic view of the structure of a virtual game machine according to the invention.

Please referring to FIGS. 2 through 4, the present invention aims to provide a game result index transaction system to connect to at least one game machine 10 which can be selectively a physical tabletop game 11 or a virtual mage machine 12 as shown in FIGS. 3A, 3B and 3C for various embodiments of the physical tabletop game 11 that can be a Baccarat tabletop 11A (as shown in FIG. 3A), a crap game tabletop 11B (as shown in FIG. 3B) or a roulette tabletop 11C (as shown in FIG. 3C), or the like. The physical tabletop game 11 generates game results through operation of a dealer 80. For instances, on the Baccarat tabletop 11A the dealer 80 manually deals pokers 81 to generate the game results; on the crap game tabletop 11B the dealer 80 manually shakes a dice cup 82, and on the roulette tabletop 11C the dealer 80 manually controls rotation of a roulette wheel 83. On the other hand, the virtual game machine 12 (as shown in FIG. 4) generally includes a display screen 12A and an user interface 12B to allow a player 90 to operate and use, and the game results are generated randomly through a computer.

The invention allows at least one player 90 to do transaction, and includes a database 20, an index conversion element 30 and an index transaction unit 40. The database 20 is connected to each game machine 10 and registers the game results of the game machine 10. The index conversion element 30 is connected to the database 20 and generates an index 50 based on the game results of the game machine 10 (referring to FIG. 5). The index 50 rises and falls with the game results continuously generated at the game machine 10. In order to make the rise and fall of the index 50 to correlate with the game results of the game machine 10, the invention captures only two dimensional game results. For instances, on the Baccarat tabletop 11A the game results take only "Dealer win" or "Player win"; on the crap game tabletop 11B the game results take only "Big" or "Small"; and on the roulette tabletop 11C the game results take only "Black" or "Red".

The index transaction unit 40 is connected to the index conversion element 30 to get the rise and fall of the index 50. The index transaction unit 40 also has a transaction interface 41 to allow the player 90 to make transaction of futures against the rise and fall of the index 50.

Figure 5:
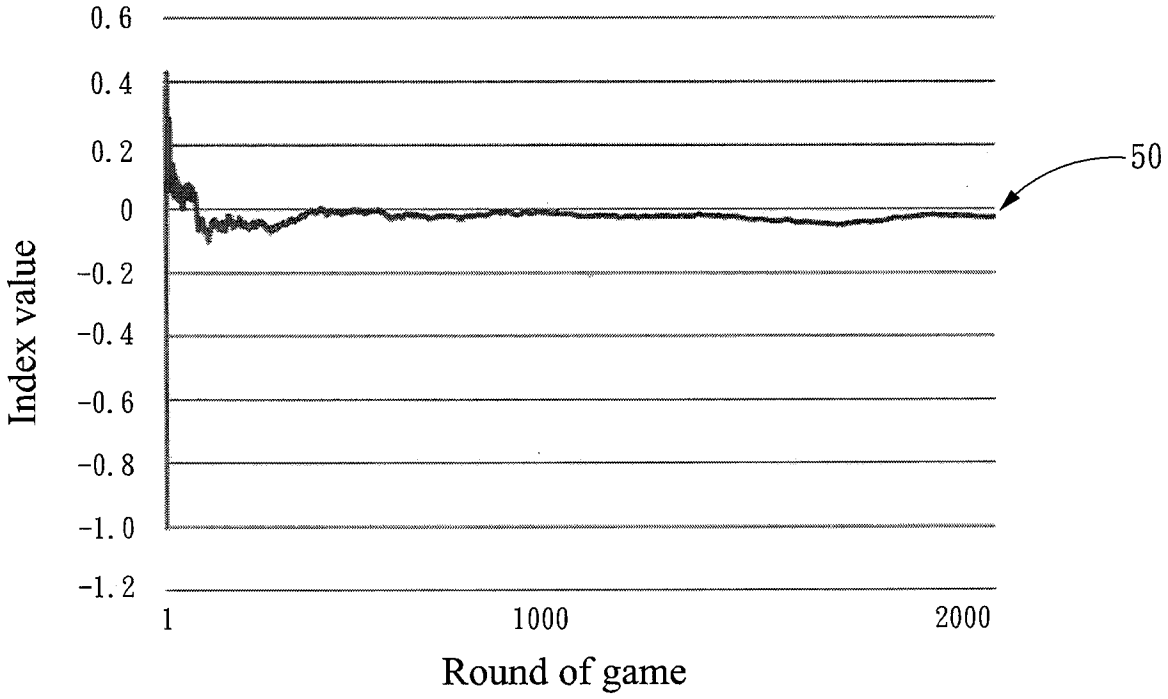
FIG. 5 is a schematic view showing index rise and fall according to the invention.

Please refer to FIG. 5 for a schematic view of the rise and fall of the index 50, with the X axis representing round of game, and the Y axis representing index value after conversion via the index conversion element 30. The rise and fall of the index 50 is related to the results of the round of game. The game results shown in FIG. 5 are generated randomly. Due to a great amount of data are involved, they are not listed in other tables. As shown in the drawing, the index 50 rises and falls according to the game results that are generated continuously at the game machine 10. The player 90 can make the transaction of futures at any time (round of game). If the player 90 has the futures on hand, whenever the index 50 rises or falls the player 90 is entitled to have an unrealized gain or loss. When the player 90 wants to cash out the gain or loss, he/she can merely close the futures transaction. The play practice thus provided is simpler without related to generation of the game results at the game machine 10, hence does not require test for a prolonged period of time, and also does no need authentication of an impartial third party, thus can greatly reduce development time and implementation cost.

Figure 6:
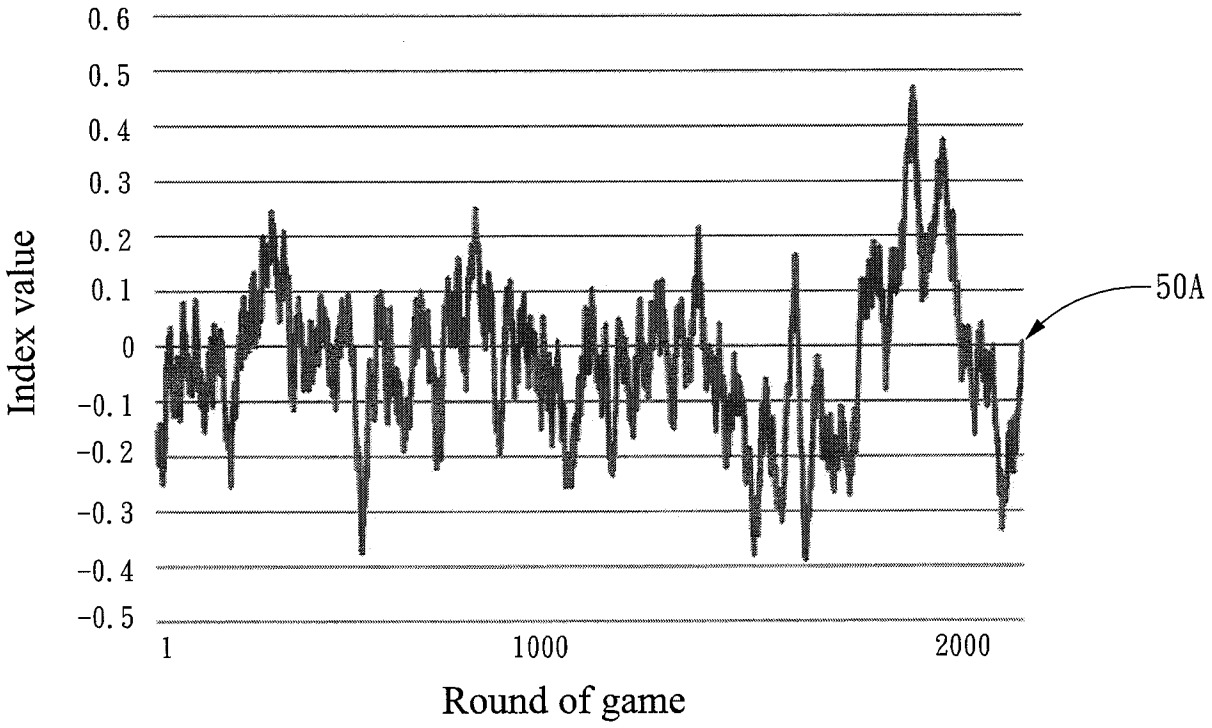
FIG. 6 is a schematic view showing weighted index rise and fall according to the invention.

Please also referring to FIG. 6, in order to increase the rise and fall magnitude of the index 50 the database 20 can further register the rounds of game that generate the game results at each game machine 10. The index conversion element 30 weights according to the rounds of game to generate the index 50A. Based on a same given data the process which is weighted can generate a greater variation on the index 50A as shown in FIG. 6. As a result, a greater change also can take place on the gain and loss of the player 90 to add excitement during playing.

The weighted process can be implemented in various fashions. For instances, a greater weight proportion can be offered to the game machine 10 which generates the game results in a fewer rounds of game; or, when the game results of the game machine 10 are same consecutively, the index 50 generated by the index conversion element 30 is weighted; or the weight proportion can be increased with increased happening frequency of consecutive same game results at the game machine 10.

Figure 7:
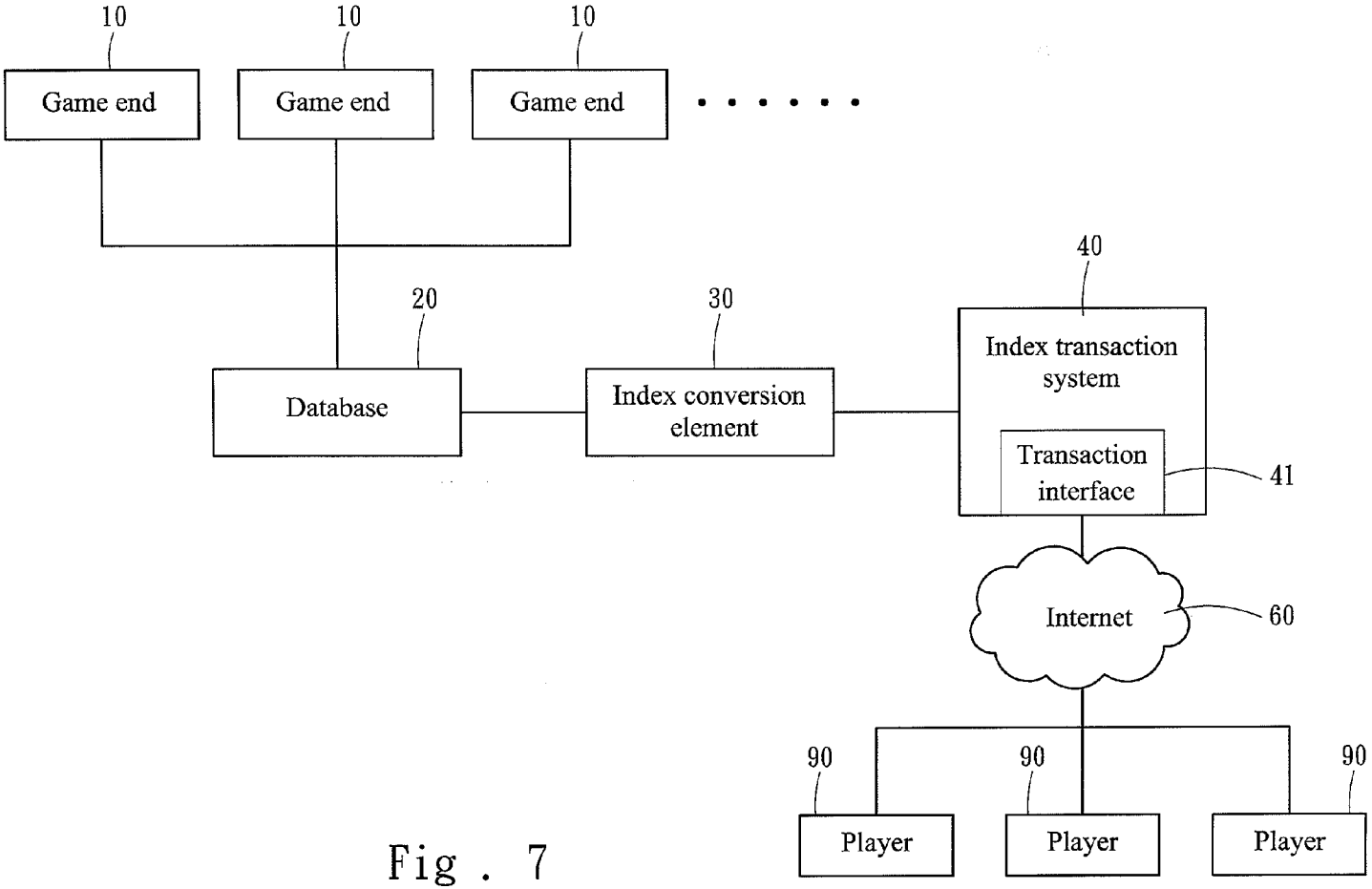
FIG. 7 is a schematic view of system architecture of another embodiment of the invention.

Please also referring to FIG. 7, the player 90 also can connect to the transaction interface 41 through an Internet 60, namely, the player 90 can directly link to the transaction interface 41 at a remote site via the Internet 60 to do transaction of the futures.

Figure 8:
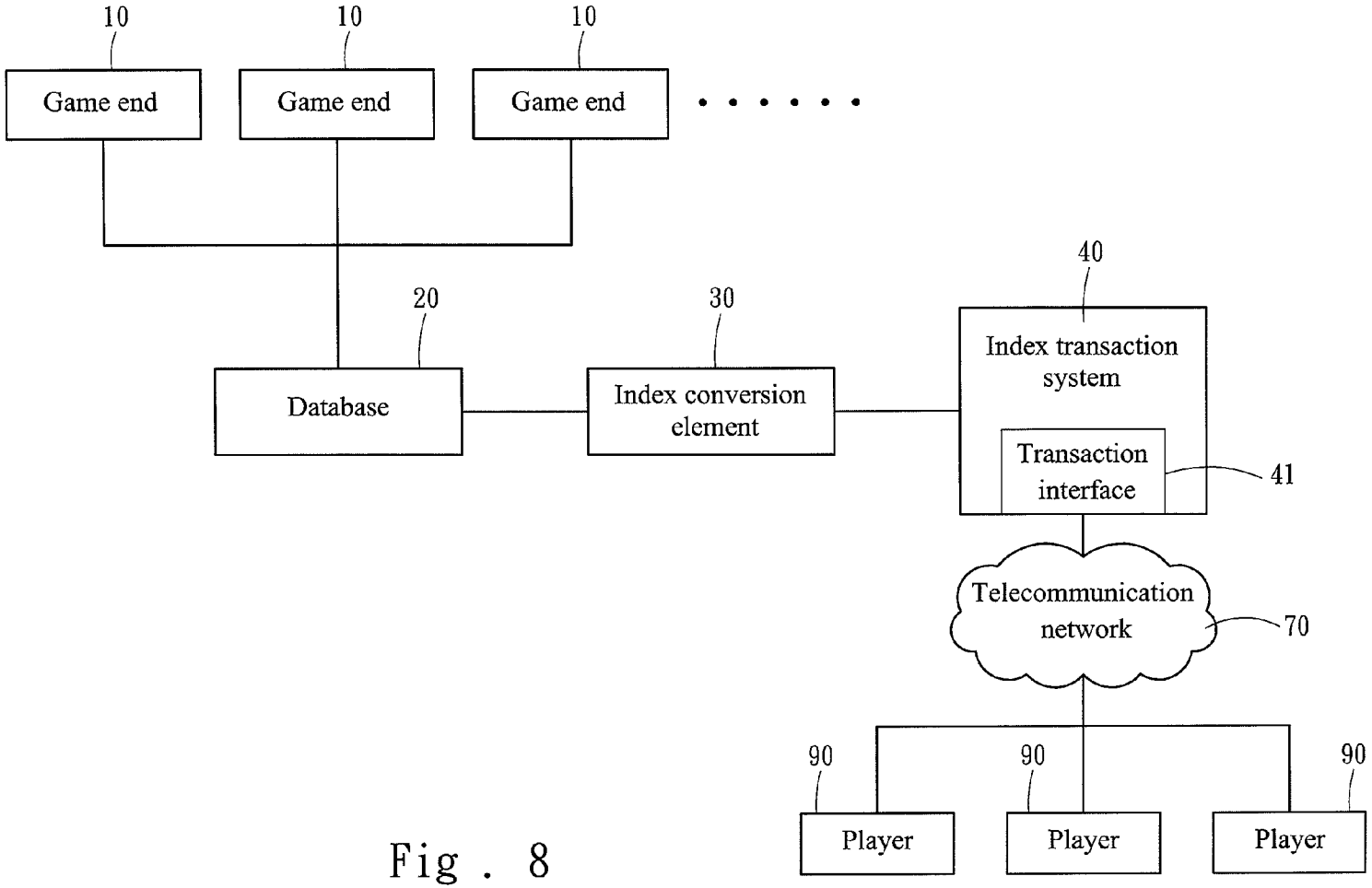
FIG. 8 is a schematic view of system architecture of yet another embodiment of the invention.

Please further referring to FIG. 8, the player 90 also can connect to the transaction interface 41 through a telecommunication network 70 which is available everywhere, then execute transaction of the futures through a telephone voice input fashion.

As a conclusion, the invention provides a game result index transaction system to allow players to buy and sell. The players can predict the game results of at least one game machine, and choose to buy or sell the futures. Hence when the index rises or falls the players can get unrealized gains or losses. And the players can close position to settle actual gains or losses. Thus the invention provides a novel play and can satisfy players' fickle desire for change and excitement. The invention does not involve generation of the game results at the game machine, and has public credibility as long as the game results are generated at the game machine. And the index rise and fall also have public credibility without the need of test for a prolonged period of time and authentication by an impartial third party, therefore can reduce development time and cost to meet game provider's requirements.

What is claimed is:

1. A game result index transaction system connected to a plurality of game terminals to allow at least one player to do a transaction, wherein each game terminal includes a game and executes the game to generate a game result signal, comprising:

a database linked to the game terminals, the database retrieving each of the game result signals of the game terminals, and registering each of the game result signals in the database;

an index conversion element connected to the database to convert each of the game result signals into an index in a binary format by a weighted average method, the index conversion element including a conversion mechanism for receiving at least one of the game result signals from each of the game terminals to generate an adjustment information, which is associated with the indices rising and falling based on the game result signals generated continuously at the game terminals; and an index transaction unit which is linked to the index conversion element to retrieve the adjustment information and adjust the rise and fall of the indices based on the adjustment information to display the indices on a transaction interface to allow the player entering the transaction interface and transmitting a transaction signal to execute the transaction of futures against the rise and fall of the indices.

2. The game result index transaction system of claim 1, wherein the player is linked to the transaction interface through an Internet.

3. The game result index transaction system of claim 1, wherein the player is linked to the transaction interface through a telecommunication network.

4. The game result index transaction system of claim 1, wherein the database further registers rounds of game of the game terminals that generate the game results, and the index conversion element generates the index after weighting the rounds of game of the game results.

5. The game result index transaction system of claim 4, wherein an increased weighting proportion is given to the game terminals which generate the game results in fewer rounds of game.

6. The game result index transaction system of claim 1, wherein the index conversion element executes weighting during generation of the index when the game results of the game terminals are same consecutively.

7. The game result index transaction system of claim 1, wherein an increased weighting proportion is given to the game terminals which consecutively generate same game results more frequently.

8. The game result index transaction system of claim 1, wherein the game terminals are selectively a physical tabletop game terminal or a virtual game terminal.

* * * * *